United States Patent [19]

Schill

[11] 4,089,391

[45] May 16, 1978

[54] CATCH APPARATUS FOR A LOADING CARRIAGE ON AN INCLINED DRIFT ELEVATOR

[76] Inventor: Tage Schill, Karestad, Hovmantorp, Sweden, S-360 51

[21] Appl. No.: 759,716

[22] Filed: Jan. 17, 1977

[30] Foreign Application Priority Data

Jan. 23, 1976 Sweden ..... 7600684

[51] Int. Cl.[2] ..... B66B 5/26

[52] U.S. Cl. ..... 187/12; 187/89

[58] Field of Search ..... 187/13, 14, 12, 75, 187/76, 89, 90, 91, 73, 82, 83, 84; 182/112, 141, 142; 188/189

[56] References Cited

U.S. PATENT DOCUMENTS

| | | | |
|---|---|---|---|
| 292,366 | 1/1884 | Rosquist | 187/13 |
| 375,203 | 12/1887 | Schuller | 187/13 |
| 437,993 | 10/1890 | Isenberg | 187/91 X |

FOREIGN PATENT DOCUMENTS

| | | | |
|---|---|---|---|
| 208,910 | 5/1968 | U.S.S.R. | 187/90 |

*Primary Examiner*—Evon C. Blunk
*Assistant Examiner*—James L. Rowland
*Attorney, Agent, or Firm*—John J. Dennemeyer

[57] ABSTRACT

A catch apparatus for a loading carriage on an inclined drift elevator mounted on a stand which forms an inclined track and extends from one level to another level. The loading carriage is connected to a pulling means which moves the carriage on the track. The catch apparatus comprises a speed sensing unit coupled to a pair of carriage wheels and a locking unit provided with catch members, the locking unit being actuated by the speed sensing unit when the wheels exceed a predetermined rotary speed to pivot a catch member toward the track where it engages a reinforcing element on the track rail to arrest the carriage.

7 Claims, 4 Drawing Figures

CATCH APPARATUS FOR A LOADING CARRIAGE ON AN INCLINED DRIFT ELEVATOR

The present invention relates to a catch apparatus for a wheeled loading carriage on an inclined drift elevator mounted on a stand forming an inclined track extending from one level to another level, the loading carriage being connected by means of a rope, wire, chain or the like to a pulling means which moves the carriage on the track.

Since the track is very steep there is an inherent danger that the loading carriage would drop with great force if the rope, wire, chain or the like for some reason leaves the track. This might happen for instance if the rope or the like breaks, slackens at its coupling to the loading carriage, or a fault arises in the pulling means, and accordingly the purpose of the catch apparatus according to the invention is to effectively catch the carriage in case it should drop by cooperating in a particular way with the track to arrest the loading carriage.

In order to effect a reliable braking of the loading carriage it is an object of the invention to provide a catch apparatus which comprises a unit for sensing the rotary speed of the wheels, and a locking unit cooperating with the unit for sensing the rotary speed in such a way that this unit, when the rotary unit of the wheels exceeds a predetermined value, will actuate the locking unit to bring at least one catch member into a position in which it is caught by reinforcing elements of the track to brake the loading carriage.

This and further objects of the invention will be more specifically described below with reference to the accompanying drawings, in which.

Figure 1:
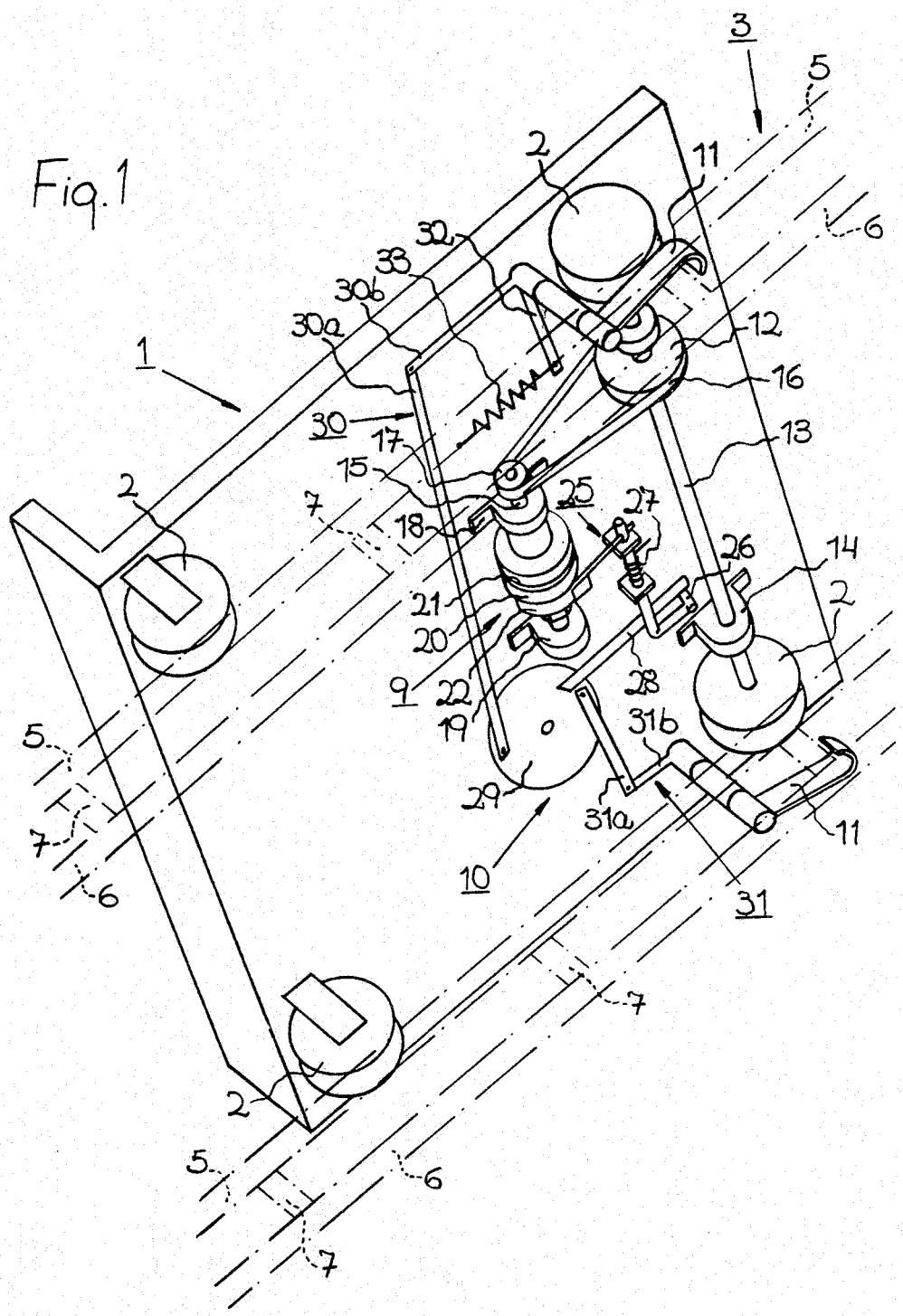
FIG. 1 is a perspective view showing parts of an inclined track stand as seen from below with a loading carriage mounted thereon and provided with a catch apparatus according to the invention.
Figure 2:
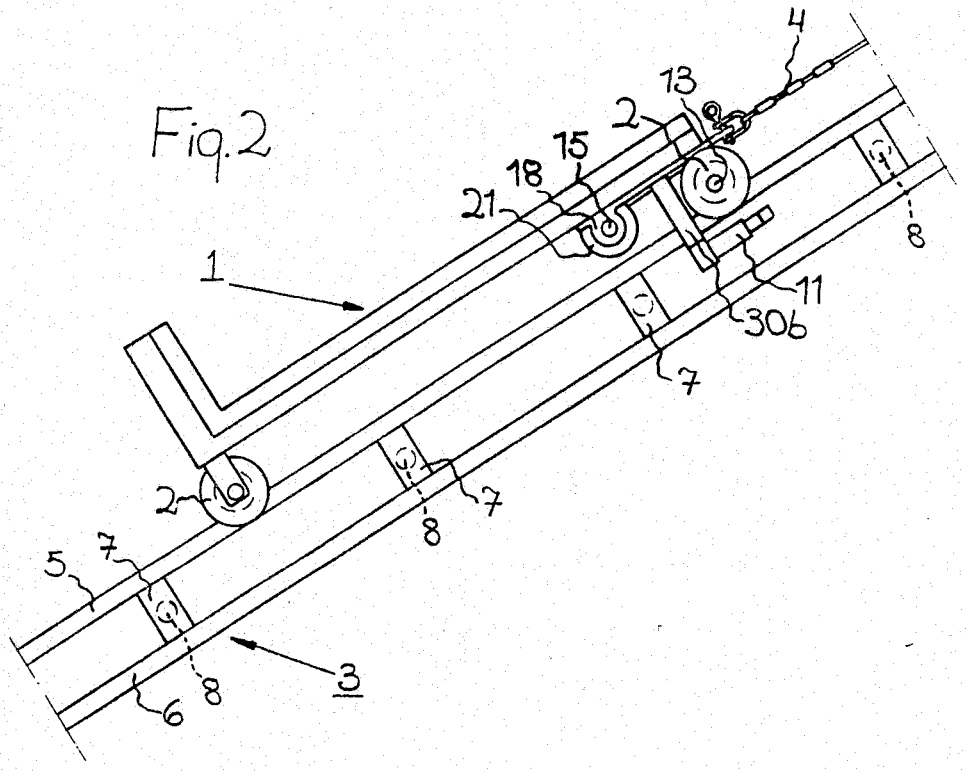
FIG. 2 is a side elevation view of the inclined track stand and the loading carriage mounted thereon.
Figure 3:
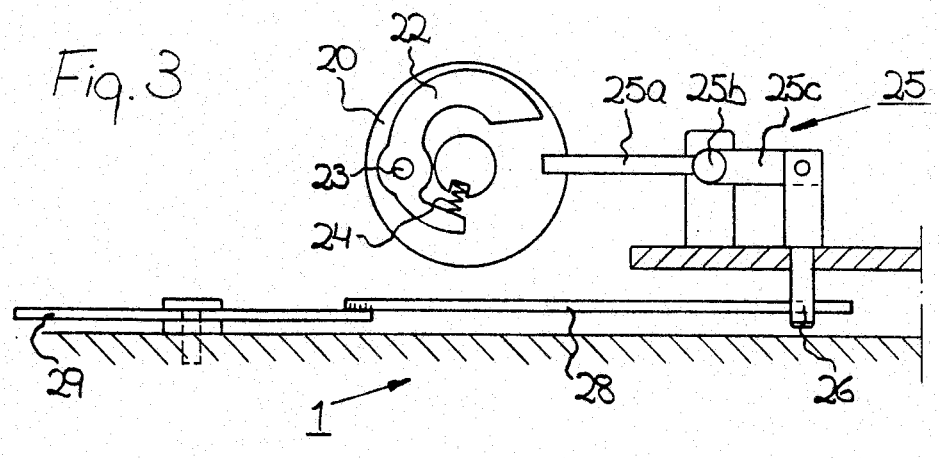
FIG. 3 is a side elevation view of parts of the catch apparatus.
Figure 4:
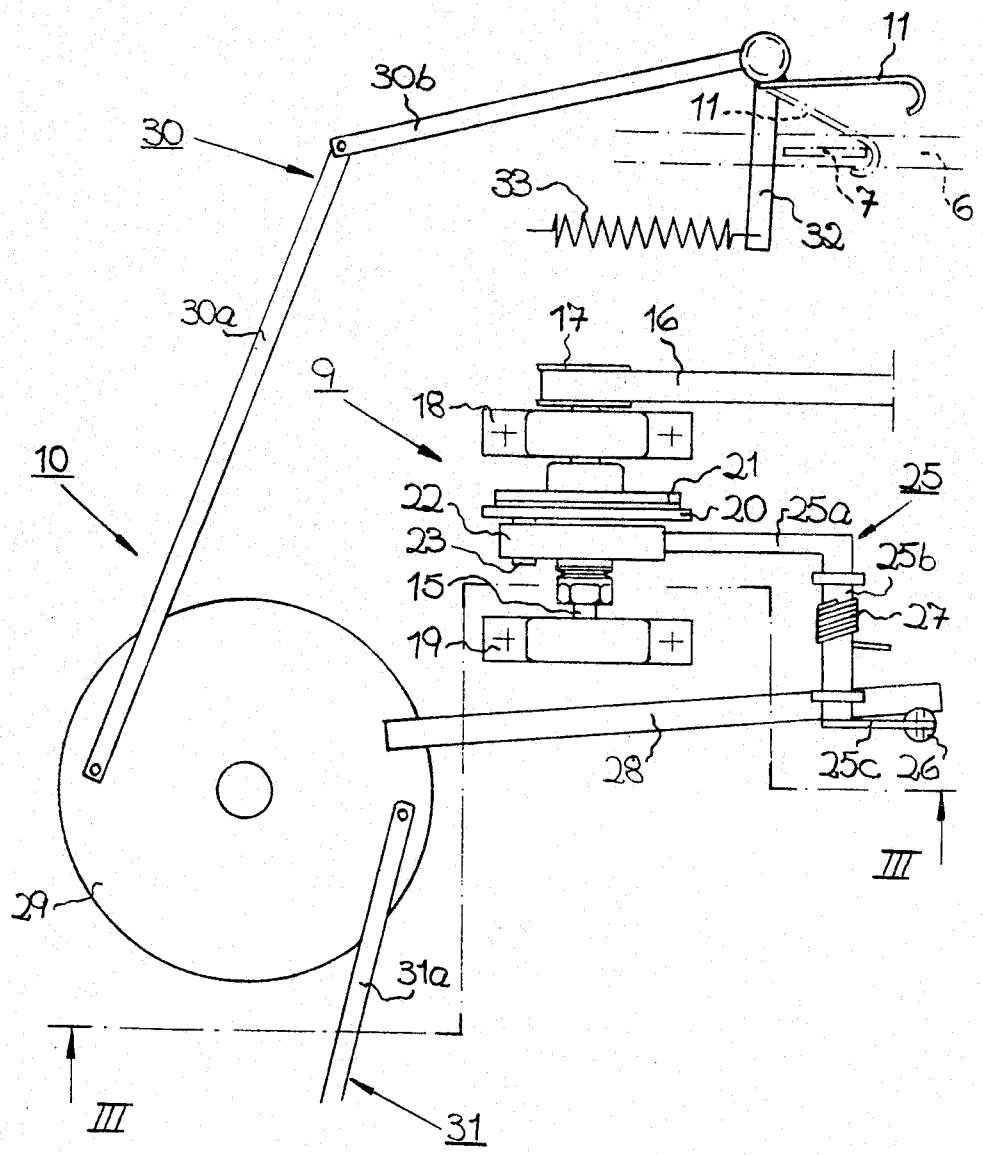
FIG. 4 is a top plan view of the parts according to FIG. 3.

As is shown in FIGS. 1 and 2, a loading carriage 1 with wheels 2 for the transporting of goods, such as pan tiles, is mounted on an inclined drift elevator comprising a stand 3 forming an inclined track extending from one level to another level. The loading carriage 1 is connected to a pulling means (not shown) in order to be moved along the track. The stand 3 forming the track comprises a pair of rails 5 and a pair of reinforcing bars 6 arranged under the rails 5 and extending longitudinally therewith and connected to the rails 5 by means of transverse reinforcing elements 7. The reinforcing elements whose function according to the invention appears from the following description preferably consist of reinforcing webs on which are mounted rods 8 for connecting portions of the stand 3 comprising the rails 5.

The catch apparatus according to the present invention comprises a unit 9 which senses the rotary speed of the wheels 2, and a locking unit 10 cooperating with the unit for sensing the rotary speed in such a way that this unit, when the rotary speed of the wheels 2 exceeds a predetermined value, actuates the locking unit 10 which thereupon places at least one catch member 11 into such a position that it is caught by the reinforcing elements 7 of the track in order to brake the loading carriage 1.

A catch member 11 preferably consists of a catch hook which is pivotally connected to the locking system 10 and preferably is formed of an elastic material in order to allow for a somewhat softer braking of the loading carriage 1.

The unit 9 for sensing the rotary speed of the wheels 2 of the loading carriage comprises a gear wheel 12 fixedly mounted on a shaft 13 connecting the wheels 2 of the loading carriage 1 and driven by the rotation of the wheels 2. This shaft is attached by means of a bearing 14 to the underside of the carriage 1. A shaft 15 is connected to and is driven from the gear wheel 12 by means of a tooth belt 16 and a gear wheel 17. The shaft 15 is also attached by means of bearings 18 and 19 to the underside of the carriage 1. A disk 20 is mounted on the shaft 15 and connected thereto by means of a sliding clutch 21. A spring-loaded release weight 22 is suitably excentrically attached at 23 to the disk 20, and when the rotation of the wheels exceeds a predetermined value, the weight 22 will be moved outwards due to its rotation and against the bias of the spring 24 so that it strikes a lever 25 (lever arm portions 25*a*, 25*b* and 25*c*) and forcibly presses it downwards. In consequence of the downward movement of the lever 25 the position of a catch 26 is changed whereby the locking unit 10 is released.

A restoring spring 27 for the lever 25 and the catch 26 on the lever 25 (lever arm portion 25*b*) is suitably mounted in order to again make possible a locking action after release of the locking unit 10.

The locking unit 10 comprises a stop arm 28 cooperating with the catch 26 and fixedly anchored to a rotary disk 29. From the rotary disk 29 preferably extend two levers 30 and 31 (lever arm portions 30*a* and 30*b*, and 31*a* and 31*b*, respectively), at least one of which, in the embodiment shown the lever 30, is actuated by an arm 32 biased by a spring 33 in such a way that when the stop arm 28 is released by the movement of the catch 26, the spring 33 will turn the levers 30, 31 and therewith the catch hooks 11 which are suitably attached to the levers 30, 31, so that they will be hooked on to the reinforcing webs 7 and brake the carriage 1.

The levers 30, 31 are pivotally attached to the rotary disk 29 and preferably disposed at an angle of 180° relative to each other.

In this way a safe and reliable catch apparatus is obtained which will function as follows: When the rotary speed of the wheels 2 exceeds a predetermined value, which is the case when the carriage falls down, the spring-loaded weight 22 is compelled to change its position and is moved outwards until it strikes the lever 25 and forcibly moves it downwards. Thereby the position of the catch 26 is changed (the catch is raised) and the stop arm 28 is released. The spring 33 will then turn the levers 30, 31 and therewith also the catch hooks 11 so that they will be hooked onto the webs 7 and brake the carriage 1, i.e. prevent the carriage from a further fall downwards. Thus the catch apparatus according to the invention with regard to its function is both simple and effective, and its construction as well is very simple.

In the embodiment described the levers 30, 31 of the locking unit 10 or the rotary disk 29 may be provided with long-holes (not shown) for adjustment of the mutual positions of the arms. The catch hooks 11, besides being formed of an elastic or resilient material, also may have fender curves in order to prevent that the hooks 11 get caught during upward movement of the loading carriage.

It will be obvious to a skilled technician that the invention may also be changed and modified within the scope of the following claims without thereby departing from the spirit and purpose of the invention.

What is claimed is:

1. A catch apparatus for a wheeled carriage operating on an inclined track, including:

a pair of rails mounted to form an inclined track, and having spaced reinforcing elements therealong;

a carriage having wheels mounted on the underside thereof, said wheels being engageable with said rails, and at least one of said wheels having shaft means connected thereto and arranged to rotate therewith;

a locking unit mounted on said carriage, and including at least one catch hook movable between a retracted position and an active position, said catch hook being arranged to engage with said reinforcing elements along said rails when in said active position thereof, and said locking unit including: resilient means arranged to urge said catch hook to move toward said active position; and catch means arranged to releasably secure said catch hook in said retracted position for normal operation of said carriage; and a sensing unit mounted on said carriage and associated with said catch means and said shaft means, said sensing unit being effective to release said catch means when the rotary speed of said one wheel exceeds a predetermined value, and including: a drive shaft rotatably mounted on the underside of said carriage; means interconnecting said drive shaft with said shaft means, effective to rotate said drive shaft in response to rotation of said one wheel; a sensing disk mounted on said drive shaft; a sliding clutch connecting said sensing disk with said drive shaft; a spring actuated release weight eccentrically attached to said sensing disk, and adapted upon exceeding of a predetermined value of the rotary speed of said one wheel to be moved radially outwards into a projecting, triggering position; an operating lever mounted on the underside of said carriage in a position to be engaged by said release weight when such is in said triggering position, and said disk is rotating, said operating lever being normally engaged with said catch means for securing said catch hook in said retracted position, and being movable by said release weight when engaged thereby to release said catch means, whereby said catch hook is freed to engage said reinforcing elements for stopping said carriage.

2. A catch apparatus according to claim 1, wherein said catch hook is formed of an elastic material.

3. A catch apparatus according to claim 2, wherein said catch hook is provided with fender curves arranged to prevent the hook from catching during upward movement of the wheeled carriage on said inclined track.

4. A catch apparatus according to claim 1, wherein said reinforcing elements of the track consist of reinforcing webs which connect said rails of the inclined track to reinforcement members positioned under and spaced from the rails, and extending longitudinally therewith.

5. A catch apparatus according to claim 1, wherein said operating lever carries thereon a stop which in consequence of said operating lever being moved by said release weight changes its position and releases said catch hook, and a restoring spring for the operating lever and said clutch, in order to again provide a locking action after release of said catch hook.

6. A catch apparatus according to claim 5, wherein said locking unit further includes:

a locking disk mounted centrally thereof on the underside of said carriage for rotational movement;

a lever pivotally mounted on the underside of said carriage, and carrying said catch hook thereon;

a connecting rod having one end thereof pivotally connected with said lever, and having its other end pivotally connected to said locking disk eccentrically thereof; and a stop arm secured to said locking disk and engageable with said stop on said operating lever, said stop arm preventing said locking disk from rotating and thereby preventing said lever from pivoting and moving said catch hook to its active position while said stop arm is engaged with said stop, and said resilient means being arranged to pivot said lever and move said catch hook to said active position when said stop on said operating arm is disengaged from said stop arm.

7. A catch apparatus according to claim 6, further including: a pair of catch hooks, one on each side of said carriage, each of said catch hooks being carried by a lever pivotally mounted on the underside of said carriage; and a pair of connecting rods, one for each of said levers, said connecting rods being connected to said disk at points spaced about 180° apart, whereby rotation of said disk by said resilient means upon release of said stop arm will be effective to move both of said catch hooks to said active position.

* * * * *